US011504590B2

(12) United States Patent
Bedard et al.

(10) Patent No.: US 11,504,590 B2
(45) Date of Patent: Nov. 22, 2022

(54) ADJUSTABLE GOLF TEE

(71) Applicant: Yatta Golf LLC, Provo, UT (US)

(72) Inventors: Abraham Bedard, Provo, UT (US); Kelby Gatrell, Provo, UT (US); Benjamin Bedard, Nauvoo, IL (US)

(73) Assignee: YATTA GOLF LLC, Provo, UT (US)

( * ) Notice: Subject to any disclaimer, the term of this patent is extended or adjusted under 35 U.S.C. 154(b) by 0 days.

(21) Appl. No.: 16/871,886

(22) Filed: May 11, 2020

(65) Prior Publication Data

US 2020/0353330 A1 Nov. 12, 2020

Related U.S. Application Data

(60) Provisional application No. 62/846,152, filed on May 10, 2019.

(51) Int. Cl.
*A63B 57/15* (2015.01)

(52) U.S. Cl.
CPC ..... *A63B 57/15* (2015.10); *A63B 2209/00* (2013.01)

(58) Field of Classification Search
CPC ..... A63B 9/0876; A63B 57/10; A63B 57/12; A63B 57/16; A63B 57/18; A63B 57/19
USPC ..... D21/717, 718
See application file for complete search history.

(56) References Cited

U.S. PATENT DOCUMENTS 2,839,304 A 6/1958 Lerick
3,114,557 A * 12/1963 Cabot ..... A63B 57/10 473/398
3,203,700 A * 8/1965 Antonious ..... A63B 57/60 473/257
3,406,977 A * 10/1968 Voelkerdingfrankj ..... A63B 57/10 473/257
3,408,079 A * 10/1968 Kirikos ..... A63B 57/10 473/398
4,951,945 A 8/1990 Gamble
5,571,055 A 11/1996 Lewis et al.
5,672,122 A * 9/1997 Strong ..... A63B 57/10 473/398
D453,810 S * 2/2002 Lee ..... D21/717
6,729,977 B1 5/2004 Young et al.
D492,374 S * 6/2004 Barouh ..... D21/718
7,156,758 B2 1/2007 Lu
(Continued)

FOREIGN PATENT DOCUMENTS

CA 2459075 A1 * 2/2005 ..... A63B 57/10
GB 346622 A * 4/1931 ..... A63B 57/15
(Continued)

OTHER PUBLICATIONS

International Search Report and Written Opinion from PCT Application No. PCT/US2020/032351, dated Aug. 14, 2020.
(Continued)

*Primary Examiner* — Steven B Wong
(74) *Attorney, Agent, or Firm* — Workman Nydegger

(57) ABSTRACT

An adjustable golf tee comprises a body extending from a head, a plurality of bulbous portions extending radially from the body and spaced apart along a length of the body, and a flexible stop adjustably secured to the body between an adjacent pair of the plurality of bulbous portions. The flexible stop comprises a disc defining a central hole through which the body is configured to pass to releasably connect the flexible stop to the body.

19 Claims, 8 Drawing Sheets

(56) References Cited

U.S. PATENT DOCUMENTS

| | | | | |
|---|---|---|---|---|
| 7,815,529 | B2 * | 10/2010 | Lee | A63B 57/15 473/398 |
| 2005/0277489 | A1 * | 12/2005 | Choe | A63B 57/10 473/396 |
| 2006/0035727 | A1 * | 2/2006 | Butterworth | A63B 57/10 473/387 |
| 2006/0199669 | A1 * | 9/2006 | Barouh | A63B 57/10 473/398 |
| 2008/0039238 | A1 * | 2/2008 | Lee | A63B 57/12 473/400 |
| 2009/0253536 | A1 * | 10/2009 | Funke | A63B 57/10 473/398 |
| 2010/0173730 | A1 * | 7/2010 | Iacono | A63B 57/10 473/398 |
| 2014/0057740 | A1 * | 2/2014 | Liao | A63B 57/12 473/393 |
| 2017/0001085 | A1 * | 1/2017 | Russell | A63B 71/0009 |
| 2017/0173423 | A1 * | 6/2017 | Ciasullo | A63B 57/15 |

FOREIGN PATENT DOCUMENTS

| | | | | |
|---|---|---|---|---|
| GB | 481698 | | 3/1938 | |
| WO | 9306897 | | 4/1993 | |
| WO | WO-2005087327 | A1 * | 9/2005 | A63B 57/13 |
| WO | 2007149576 | A2 | 12/2007 | |
| WO | WO-2009054849 | A1 * | 4/2009 | A63B 57/10 |

OTHER PUBLICATIONS

Zero Friction, Zero Friction Lock n Drive Tees, retrieved from https://www.zerofriction.com/golf-teeshtml/lock-n-drive-2html, Sep. 25, 2020.

Martini Tees, Martini Step-Up Golf Tees 3 ¼, retrieved from https://www.amazon.com/Martini-Step-Up-Golf-Tees-Multicolor/dp/B00HHYUZZW, Sep. 25, 2020.

Chinese Office Action from corresponding Chinese Patent Application No. 202080034845.6, dated Jun. 1, 2022.

Chinese Search Report from corresponding Chinese Patent Application No. 202080034845.6, dated May 26, 2022.

* cited by examiner

ADJUSTABLE GOLF TEE

BACKGROUND OF THE INVENTION

1. The Field of the Invention

Embodiments of the present disclosure relate generally to golf tees. More specifically, the present disclosure relates to adjustable-height golf tees.

2. The Relevant Technology

When striking a ball seated on a golf tee, it is important to consistently position the tee so that it extends above the ground at the same height from one strike to another. A consistent tee height allows a golfer to strike the ball more consistently without adjusting his or her club swing in response to varying tee heights. However, most tees commonly used by golfers lack any mechanism that ensures a tee is inserted to a consistent height above the ground, leading to inconsistent performance by the golfer.

Different clubs and different holes require the tee to be inserted at different heights. For example, when using a driver, a user may insert the tee a minimal distance into the ground so that the ball stands at an ideal height for the driver, which is larger than other clubs. Similarly, when using a wood, a user may insert the tee a greater distance into the ground commensurate with the size of the wood. When using an iron, the user may insert the tee a maximal distance into the ground commensurate with the size of the iron. The different heights that a user may insert a tee throughout a round of golf further complicates the difficulty of inserting the tee at a consistent height.

Existing tees further lack a mechanism ensuring that the tee is inserted orthogonally into the ground, providing for a stable and predictable support for the ball, rather than extending crookedly. A crookedly extending tee may lead to the ball falling off the tee or having an undesired flight path upon being struck by the club.

In addition, when teeing off, the club head typically strikes the tee as well as the ball seated thereon. Standard wooden golf tees tend to break when struck. Plastic and rubber golf tees are more durable but may still be launched out of the ground when hit. Tees that launch out of the ground are hard to find and golfers often do not retrieve them. Rather, these tees are left to accumulate on and around the tee box, leaving a littered mess of broken and discarded tees. Plastic tees also suffer from permanent deformations that render the tee unusable after a few or even a single swing. While many tees are designed to be disposable, the lack of durability of tees nevertheless increases the cost of golfing and generates undesired amounts of waste.

Accordingly, there are a number of disadvantages in the art of golf tees that can be addressed.

BRIEF SUMMARY

The present disclosure relates generally to golf tees. More specifically, the present disclosure relates to adjustable-height golf tees. For example, in one embodiment of the present disclosure, an adjustable golf tee comprises a body extending from a head, a plurality of bulbous portions extending radially from the body and spaced apart along a length of the body, and a flexible stop adjustably and removably secured to the body between an adjacent pair of the plurality of bulbous portions.

In one embodiment of the present disclosure, an adjustable golf tee comprises a body extending from a head. The body includes a plurality of bulbous portions extending radially from the body and spaced apart along the length of the body. The tee also includes a flexible stop that is adjustably secured along the length of the body. The flexible stop comprises a disc with a central hole passing through the disc.

In one embodiment of the present disclosure, a method of placing a golf tee at a consistent height includes providing a golf tee according to embodiments. The golf tee has a body extending from a head and a plurality of spaced apart bulbous portions extending radially from the body. The method also includes removably disposing a stop along the length of the body. The method also includes inserting the body into the ground until the stop contacts the ground and prevents the length of the body disposed above the stop from being inserted into the ground.

Additional features and advantages of exemplary embodiments of the present disclosure will be set forth in the description which follows, and in part will be obvious from the description or may be learned by the practice of such exemplary embodiments. The features and advantages of such embodiments may be realized and obtained by means of the instruments and combinations particularly pointed out in the appended claims. These and other features will become more fully apparent from the following description and appended claims or may be learned by the practice of such exemplary embodiments as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific implementations and/or embodiments thereof which are illustrated in the appended drawings. Understanding that these drawings depict only typical implementations and/or embodiments of the invention and are not therefore to be considered to be limiting of its scope, the invention will be described and explained with additional specificity and detail through the use of the accompanying drawings in which.

DETAILED DESCRIPTION

The present disclosure relates generally to golf tees. More specifically, the present disclosure relates to adjustable height golf tees. Embodiments of devices and methods described herein allow a golfer to insert a golf tee into the ground so that the tee extends above the ground to a pre-selected and consistent height. In addition, embodiments of devices and methods described herein provide a golf tee that does not break or launch out of the ground when struck by a golf club.

Figure 1:
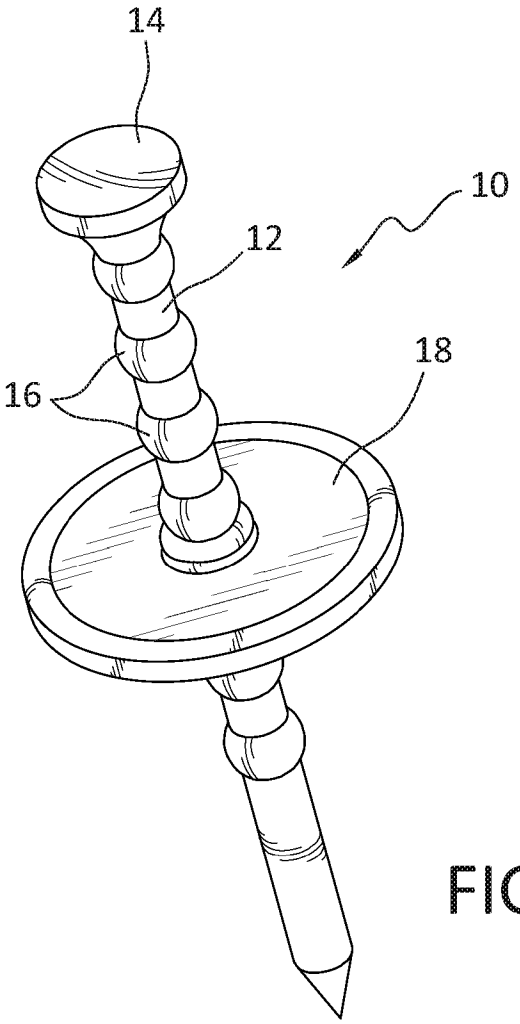
FIG. 1 illustrates a perspective view of an embodiment of an adjustable golf tee, according to the present disclosure.

Turning now to the figures, FIG. 1 illustrates a perspective view of an embodiment of an adjustable golf tee 10. In the illustrated embodiment, the tee 10 includes a longitudinal or elongate body 12 extending from a head 14. The body 12 includes a plurality of bulbous portions 16 extending radially outward from the body 12 and separated from one another along at least a portion of the length of the body 12. A transition angle from an outer surface of the body 12 at each of said space portions to an outer surface of the respective bulbous portions 16 may be an obtuse angle, as shown, for example, in FIGS. 1-9. In addition, the golf tee 10 includes a stop 18 removably secured around the body 12.

Figure 2:
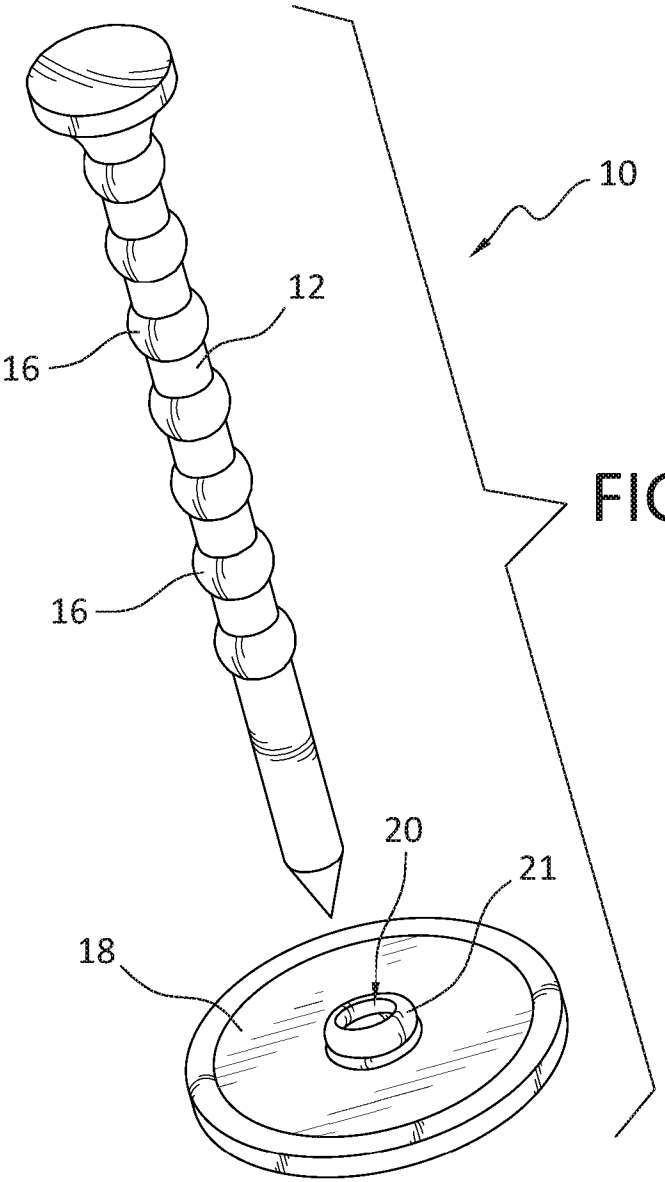
FIG. 2 illustrates an exploded view of the adjustable golf tee of FIG. 1.

As shown in the exploded view of FIG. 2, at least one embodiment of the tee 10 includes seven bulbous portions 16 spaced apart along a portion of the length of the body 12. In one or more other embodiments, the body 12 may include more or less than seven bulbous portions 16 extending therefrom as suitable. Also, as shown in the exploded view of FIG. 2, the stop 18 includes a disc having a central hole 20 through which the body 12 may extend during use to secure the stop 18 to and/or about the body 12, as shown in FIG. 1.

In at least one embodiment, the diameter of the central hole 20 of the stop 18 is less than the diameter at the center or apex of each of the bulbous portions 16, but equal to or greater than the diameter of the body 12 between each bulbous portion 16. Alternatively, the diameter of the central hole 20 of the stop 18 may also be less than the diameter of the body 12 between bulbous portions 16 when the body 12 is not inserted through the central hole 20 during use, as shown in FIG. 1.

In at least one embodiment, the stop 18 comprises flexible material so that the diameter of the central hole 20 may expand over the bulbous portions 16 as the body 12 is inserted through the central hole 20. As seen from the front view illustrated in FIG. 3, the body 12 may be inserted through the central hole 20 of the stop 18 until the stop is in a desired position along the body 12 between two adjacent bulbous portions 16. Once the stop 18 is positioned between two adjacent bulbous portions 16, the diameter of the central hole 20 elastically returns smaller than the diameter of the bulbous portions 16 so that the adjacent bulbous portions 16 on opposing sides of the stop 18 maintain the stop 18 in the desired position along the length of the body 12.

In addition, the stop 18 may include a central protrusion 21 surrounding the central hole 20 that extends above and/or below the central hole 20. The protrusion 21 is flexible so that the protrusion 21 also expands and elastically returns along with the diameter of the central hole 20 as the stop 18 is positioned onto the body 12 of the tee 10, as described herein. Advantageously, the protrusion 21, both above and beneath the stop 18, contacts both adjacent bulbous portions 16 when the stop 18 is positioned between bulbous portions 16 as shown in FIGS. 1, 3-4, and 7-8. As such, the protrusion 21 resists movement of the stop 18 over any of the bulbous portions 16 during use to keep the stop 18 from slipping up or down along the length of the body 12. The stop 18 thus acts as an insertion barrier as described herein, during use.

While the central protrusion 21 has been shown and described, it will be appreciated that any suitable configuration of the stop 18 may be used. In embodiments, the stop 18 may have a uniform thickness without protrusions, thereby defining a flat shape. This may be advantageous, for example, in providing a simple and cost-effective stop 18. In such embodiments, a thickness of the stop 18 may be configured to fit flush against adjacent bulbous portions 16 on both a top and a bottom side of the stop 18 as described herein so as to secure the stop 18 in place along the body 12 of the tee 10.

The stop 18 can thus be positioned along the length of the body 12 between any two adjacent bulbous portions 16. When the tee 10 is inserted into the ground during use, the length of the body 12 below the stop 18, i.e. distally located relative to the head 14, may be disposed beneath or in the ground, while the length of the body 12 above the stop 18, i.e. proximally located relative to the head 14, remains above the ground. The stop 18 provides an insertion barrier so that only the length of the body 12 below the stop 18 is inserted. In this way, a golfer can choose to position the stop 18 at certain positions along the body 12 so that a golf ball placed on top of the head 14 sits at a consistent height above the ground when the golfer tees off.

While the stop 18 being positioned between adjacent bulbous portions 16 has been shown and described, it will nevertheless be understood that the stop 18 may be positioned about one of the bulbous portions 16, with the central hole 20 expanded to extend about a portion of the bulbous portion 16. In embodiments, due to the elastic properties of the central hole 20 and the stop 18, the stop 18 may be positioned at any location about any one of the bulbous portions 16. In other embodiments, the stop 18 may be positioned on a bulbous portion 16 or between adjacent bulbous portions 16, providing a user with numerous height settings.

Advantageously, the stop 18 can also be adjusted along the length of the body 12 from one tee shot to another, depending on the club being used or other conditions that may dictate how high above the ground a golfer wants the ball. Whatever height the golfer chooses can be consistently maintained from one tee shot to another until the position of the stop 18 along the length of the body 12 is purposely changed. Also, advantageously, the stop 18 can be removed from the body 12 and used as a ball marker.

Accordingly, a method of placing a golf tee at a consistent height comprises: 1) providing a golf tee 10 having a body 12 extending from a head 14 and a plurality of spaced-apart bulbous portions 16 extending radially from and along a portion of a length of the body 12; 2) disposing a stop 18 along a length of the body 12; and 3) inserting the body 12 into the ground until the stop 18 contacts the ground and prevents a length of the body 12 disposed above the stop 18 from being inserted into the ground. In addition, disposing the stop 18 along the length of the body 12 may comprise inserting the body 12 of the tee 10 through the central hole 20 of the stop 18 such that the diameter of the central hole 20 elastically expands to pass over each of the plurality of bulbous portions 16 inserted through the central hole 20.

In embodiments, the tee 10 may have a total length of up to four inches. In embodiments, the tee 10 may be smaller, for example 2.75 inches, 3.25 inches, or otherwise. It will be appreciated that while the head 14 has been shown, a multi-pronged head, such as a three-pronged head, may also be used. The head 14 may have any suitable size, and may be larger or smaller, or asymmetrically shaped, as suitable.

In embodiments, the head 14 may have a diameter of up to about 0.4 inches. The head 14 may be larger or smaller as suitable, and may define a concavity of any suitable dimensions for receiving a golf ball. The body 12 may comprise a distal section without the bulbous portions 16. The distal section without the bulbous portions 16 may extend approximately one inch, though in embodiments it may extend shorter or longer. A section of the body 12 over which the bulbous portions 16 extend, by contrast, may extend approximately two inches, though in embodiments it may extend shorter or longer.

In embodiments, an individual section of the body 12 extending between adjacent bulbous portions 16 may extend approximately 0.1 inch, though in embodiments it may extend longer or shorter. The sections of the body 12 between the bulbous portions 16 may have a universal diameter and length, or may vary along the length of the body 12 as suitable. The bulbous portions 16, by contrast, may extend approximately 0.2 inch along the length of the body 12, though in embodiments the bulbous portions 16 may extend longer or shorter, and may have different lengths.

In embodiments, a diameter of the body 12 between the bulbous portions 16 and along the distal section may be approximately 0.2 inch. A diameter of the bulbous portions 16 may be approximately 0.25 inch, though in embodiments the diameters of the body 12 and the bulbous portions 16 may be more or less.

Figure 3:
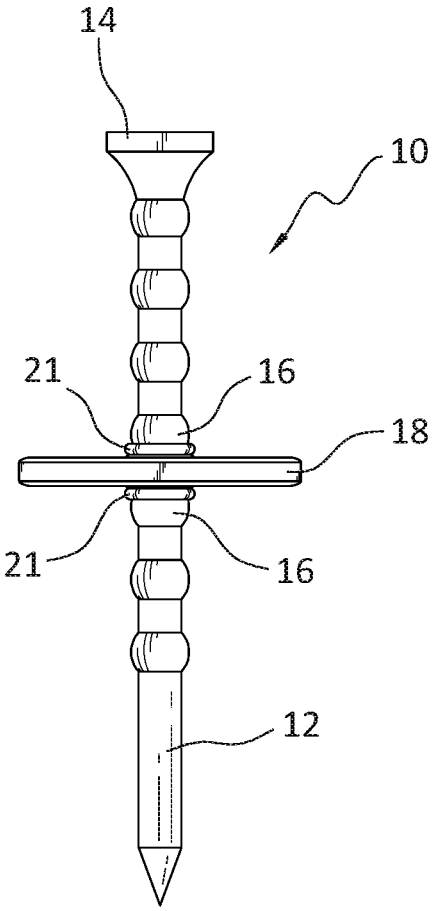
FIG. 3 illustrates a front view of the adjustable golf tee of FIG. 1.
Figure 4:
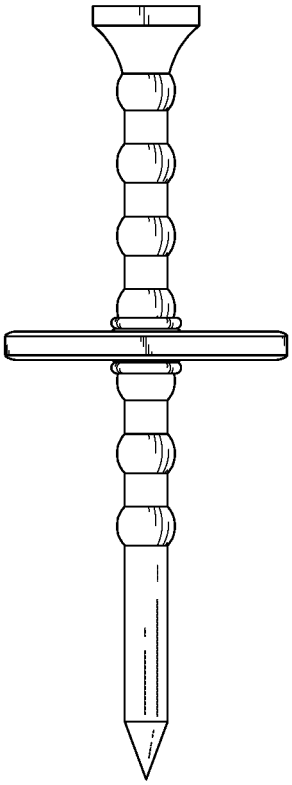
FIG. 4 illustrates a side view of the adjustable golf tee of FIG. 1.
Figure 5:
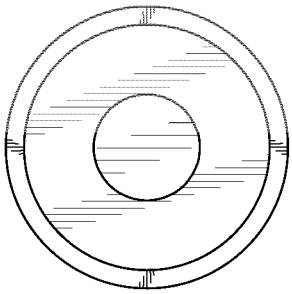
FIG. 5 illustrates a top view of the adjustable golf tee of FIG. 1.
Figure 6:
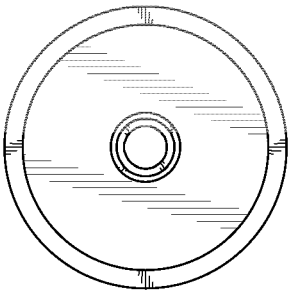
FIG. 6 illustrates a bottom view of the adjustable golf tee of FIG. 1.
Figure 7:
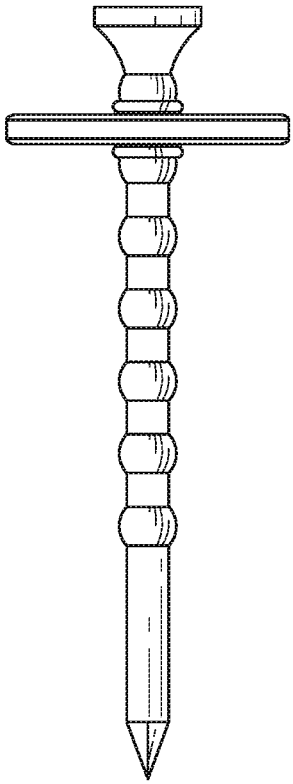
FIG. 7 illustrates a left view of the adjustable golf tee of FIG. 1.
Figure 8:
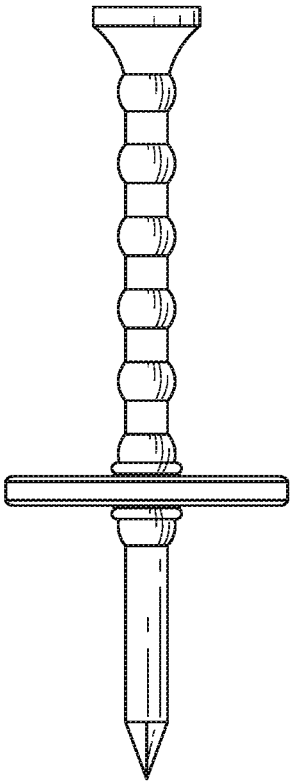
FIG. 8 illustrates a right view of the adjustable golf tee of FIG. 1.

FIGS. 4-8 illustrate various other views of the golf tee 10 illustrated in FIGS. 1-3. For example: FIG. 4 illustrates a side view thereof; FIG. 5 illustrates a top view thereof; FIG. 6 illustrates a bottom view thereof; FIG. 7 illustrates a left view thereof; and FIG. 8 illustrates a right view thereof.

In one or more other embodiments, the dimensions, shape, and configuration of the tee 10 may vary. For example, in one or more embodiments, the body 12 may be longer or shorter than that shown in the figures. Also, the diameter of the body 12 between bulbous portions 16 may vary in other embodiments.

As noted above, the number of bulbous portions 16 may vary and the size, shape, spacing, and the distribution of bulbous portions 16 along the length of the body 12 may also vary. For example, in one or more embodiments, the bulbous portions 16 may be formed as rectangular portions or triangular portions, rather than the semi-circular/spherical bulbous portions 16 illustrated in the figures. The bulbous portions 16 may likewise have different and/or asymmetric shapes at different locations along the body 12.

Likewise, the size and shape of the of central hole 20 may vary in other embodiments. For example, in one or more other embodiments, the central hole 20 may be triangular, rectangular, otherwise polygonal, or otherwise irregularly shaped. The dimensions and properties of the central hole 20 may vary so long as it accommodates the shape and size of bulbous portions 16 and the body 12 of the tee 10 to perform its functions as noted above.

In addition, the shape and dimensions of the stop 18 may vary in one or more other embodiments. For example, the stop 18 illustrated in the figures is circular but in one or more other embodiments, the stop 18 may be polygonal or irregularly shaped. For example, in at least one embodiment, the stop 18 may be shaped like a flower, a star, or any other custom shape. The stop 18 may also include logos or other designs printed thereon for promotional or aesthetic purposes. The thickness of the stop 18 may also vary so long as it can be properly disposed between bulbous portions 16 on the body 12 to create an insertion barrier, as described above.

Figure 9:
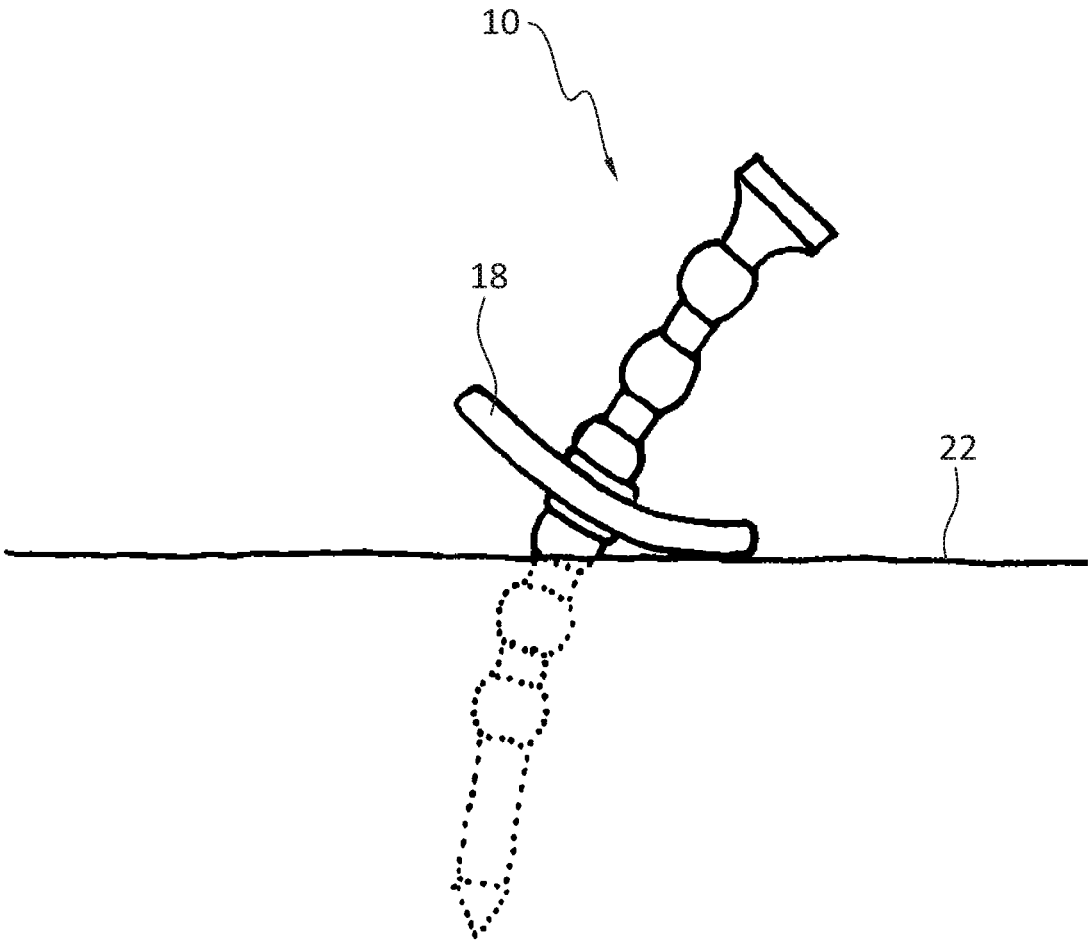
FIG. 9 illustrates an embodiment of an adjustable golf tee flexing in response to being struck by a club when inserted into the ground, according to the present disclosure.

FIG. 9 illustrates an embodiment of an adjustable golf tee 10 flexing in response to being struck by a club when inserted in the ground 22. Typically, when a tee of the prior art is struck by a club, the tee will break and/or be launched out of the ground and lost. Tees having rigid or stiff locking mechanisms that break or bend after repeated used render any locking mechanism or rigid stop from properly functioning, either to deformations in the tee or the stop/locking mechanism or both.

As illustrated by the embodiment shown in FIG. 9, the tee 10 may be flexible so that it elastically bends in response to being struck. In addition, the stop 18 is sufficiently flexible so that, when the tee 10 tends to come out of the ground 22 as the tee 10 flexes, the stop 18 also flexes. The flexion of the stop 18 acts to absorb and dampen at least a portion of the forces acting on the tee 10 so that the tee 10 does not come completely come out of the ground 22.

The stop 10 must be sufficiently flexible to absorb at least a portion of the forces acting on the tee 10. Conversely, if the stop 18 is too stiff and inflexible, the stop 18 may not sufficiently flex and absorb the forces acting on the tee 10. In such a case, the stop 18 may not prevent the tee 10 from launching out of the ground 22.

Thus, as noted above, the material flexibility of the stop 18 provides a number of advantages. For example, the material flexibility of the stop 18 enables the central hole 20 of the stop 18 to expand over the bulbous portions 16, which allows the body 12 and bulbous portions 16 to be inserted through the stop 18. The flexibility also enables the diameter of the central hole 20 to reduce once the stop 18 is positioned between adjacent bulbous portions 16. Once positioned, because of the reduction of the diameter of the central hole 20, the pair of adjacent bulbous portions 16 resist the passing of the central hole 20 over the bulbous portions 16 such that the position of the stop 18 along the length of the body 12 is maintained and the stop 18 serves as a sufficient insertion barrier.

Also, for example, the material flexibility of the stop 18 enables the stop 18 to absorb forces and flex in response to the tee 10 being struck, thus keeping the tee 10 from launching out of the ground 22 during use. Even if the tee 10 bends or slightly deforms after repeated use, the flexibility of the stop 18 allows the stop 18 to still work with the bent tee 10 and prevents the stop 18 itself from deforming after multiple uses.

As such, it is important that the material and dimensions of the stop 18 are flexible enough to provide the aforementioned advantages but stiff enough to maintain the stop 18 at the desired position between adjacent bulbous portions 16 without slipping out of position too easily during use. To achieve the aforementioned advantages, in at least one embodiment, the stop 18 comprises a thermoplastic polyurethane or other flexible elastomer material having a shore hardness of between about 70 A and 100 A using the ASTM D638 test method. In at least one embodiment, the shore hardness of the material of the stop 18 may be between about 75 A and 95 A, between about 80 A and 90 A, or about 85 A, using the ASTM D638 test method. In other embodiments, the shore hardness of the stop 18 may be assessed using the ASTM-D2240 test method.

In embodiments, the stop 18 may comprise an elongation measured using the ASTM-D412 method of between 300% and 1000%, in embodiments preferably between 500% and 800%, and even more preferably between 700% and 750%. The stop 18 may also comprise a tensile strength measured using the ASTM-D412 method of between 20 and 60 MPa, in embodiments preferably between 25 and 50 MPa, and even more preferably between 30 and 40 MPa.

In embodiments, the stop 18 may comprise a 100% modulus measured using the ASTM-D412 method of between 3 and 6, in embodiments preferably between 4 and 5, even more preferably between 4.4 and 4.8. The stop 18 may comprise a 300% modulus measured using the ASTM-D412 method of between 4 and 10, in embodiments preferably between 6 and 8, even more preferably between 7.4 and 7.8.

In embodiments, the stop 18 may comprise a tear strength measured using the ASTM-D624 method of between 70 and 100 KN/m, in embodiments preferably between 85 and 95 KN/m, even more preferably between 87 and 91 KN/m. The stop 18 may further have a beginning flow temperature of between 140 and 200° C., in embodiments preferably between 160 and 190° C., even more preferably between 175 and 185° C.

In addition, in order to provide the aforementioned advantages, the material of the stop 18 may have a tensile yield strength between about 500 psi and 700 psi, between about 550 psi and 650 psi, between about 570 psi and 600 psi, or between about 575 psi and 585 psi, and preferably about 580 psi, using the ASTM D638 test method.

The material of the stop 18 may have an ultimate tensile strength between about 2,700 psi and 5,000 psi, between about 3,300 psi and 4,300 psi, between about 3,500 psi and 3,900 psi, and preferably about 3,700 psi, using the ASTM D638 test method.

Additionally, the material of the stop 18 may have an elongation at yield of between about 50% and 80% and preferably about 65% and an elongation at break of between about 500% and 800%, and preferably about 660%, using the ASTM D638 test method.

In addition, in at least one embodiment, the body 12 of the tee 10 may comprise a high impact-strength plastic, such as an impact-modified nylon resin material or the like, such that striking the tee 10 with a club at typical club head speeds does not result in failure anywhere along the body 10 or head 14 of the tee 10. In embodiments, the body 12 of the tee 10 comprises an impact-modified nylon resin, such as available from DuPont de Nemours, Inc. of Wilmington, Del. under the trade name Zytel®. In other embodiments, any other suitable material, including synthetic materials such as plastics of any suitable dimensions and properties, wood, bamboo, hemp, corn-based polymer, metals, hardened cardboard, combinations thereof, recycled materials such as recycled plastic or tire rubber, or otherwise may be used.

In embodiments, the tee 10 may comprise a distinct core and a distinct sleeve engaging with the core. The core may be hardened to provide additional structural support. In yet other embodiments, the tee 10 may be hollow, with only a sleeve surrounding a longitudinal aperture. This may advantageously reduce a material cost of the tee 10 and/or provide other desired properties.

The body 12 of the tee 10 may be injection molded from pellets to a desired configuration. In embodiments, the body 12 or the stop 18 may be produced using additive manufacturing. In such embodiments, the body 12 and/or the stop 18 may have a user-specific or custom shape. In embodiments, the body 12 and/or the stop 18 may have a unique shape, such as a novelty shape specific to a user, while retaining one or more of the advantageous features of the present disclosure. For example, the body 12 and/or the stop 18 may comprise a logo-specific shape. The body 12 and/or the stop 18 may further be configured to have graphics applied to or printed on at least a portion of the surface thereof.

The material forming the body 12 may comprise additives for heat stability and mold release. In embodiments, the body 12 may have a dry density measured using the ISO 1183 method of between 0.5 and 1.5 g/cm$^3$, in embodiments preferably between 0.75 and 1.25 g/cm$^3$, even more preferably between 0.9 and 1.1 g/cm$^3$. The viscosity of the material as measured using the ISO 307 test method may be between 50 and 250 cm$^3$/g, in embodiments preferably between 100 and 200 cm$^3$/g, even more preferably between 110 and 150 cm$^3$/g.

In embodiments, the body 12 may demonstrate a molding shrinkage across flow as measured using the ISO 294-4 method of between 0.5 and 3.0%, in embodiments preferably between 0.75 and 2.0%, even more preferably between 1 and 1.75%. The molding shrinkage across flow at 80° C. for 48 hours as measured using the ISO 294-4 method may be between 0.01 and 0.5%, in embodiments preferably between 0.025 and 0.25%, even more preferably between 0.04 and 0.1%. The body 12 may have a flow as measured using the ISO 294-4 method of between 0.5 and 5%, in embodiments preferably between 1.0 and 2.5%, even more preferably between 1.5 and 2.0%. The flow at 80° C. for 48 hours as measured using the ISO 294-4 method may be between 0.01 and 0.5%, in embodiments preferably between 0.025 and 0.25%, even more preferably between 0.04 and 0.1%.

The body 12 may have a water absorption as measured using the ISO 62 test method at 24 hours, 23° C., and 3.00 mm of between 0.1 and 5%, in embodiments preferably between 0.5 and 2.5%, even more preferably between 1.0 and 1.5%. The body 12 may have a saturation as measured using the ISO 62 test method at 23° C. and 2.00 mm of between 3.0 and 10%, in embodiments preferably between 5.0 and 7.0%, even more preferably between 6.0 and 6.75%. The body 12 may further have an equilibrium at 23° C., 2.00 mm, and 50% relative humidity of between 0.5 and 5%, in embodiments preferably between 1.0 and 2.5%, even more preferably between 1.75 and 2.25%.

In embodiments, the body 12 may have a dry tensile modulus as measured using the ISO 527-2 method of between 200,000 and 400,000 psi, in embodiments preferably between 250,000 and 350,000 psi, even more preferably between 275,000 and 325,000 psi. The body 12 may have a conditioned tensile modulus of between 50,000 and 300,000 psi, in embodiments preferably between 100,000 and 200,000 psi, even more preferably between about 125,000 and 150,000 psi.

The body 12 may have a tensile stress measured according to the ISO 527-2 method, and in particular a yield, of between 5,000 and 10,000 psi, in embodiments preferably between about 6,000 and 9,000 psi, even more preferably between about 7,000 and 8,000 psi. The body 12 may have a 50% strain measured according to the ISO 527-2 method of between about 4,000 and 8,000 psi, in embodiments preferably between about 5,000 and 8,000 psi, even more preferably between about 6,000 and 7,000 psi.

The body 12, and the material forming the body 12, may have a tensile strain such that the body 12 has a yield of between 2 and 10%, in embodiments preferably between about 3 and 6%, and more preferably between about 4 and about 5% as measured according to the ISO 527-2 test method. Likewise, the break point may be greater than 20%, in embodiments preferably greater than 40%, and even more preferably greater than 50% as measured according to the ISO 527-2 test method. The break point at 73 degrees F. may be greater than 30%, in embodiments preferably greater than 50%, and even more preferably greater than 60% as measured according to the ISO 527-2 test method.

The body 12 may additionally have a dry Charpy Notched Impact Strength as measured according to the ISO 179/1eA test method at −30 degrees C. of between 5 and 15 ft-lb/in$^2$, in embodiments preferably between 7 and 12 ft-lb/in$^2$, even more preferably between 9 and 10 ft-lb/in$^2$. A corresponding conditioned impact strength may be between 5 and 10 ft-lb/in$^2$. The body 12 may have a Charpy Unnotched Impact Strength at 73 degrees F. of no break, either dry or conditioned. The body 12 may have a dry Notched Izod Impact Strength as measured according to the ISO 180/1 A test method at −40 degrees C. of between 5 and 15 ft-lb/in$^2$, in embodiments preferably between 7 and 12 ft-lb/in$^2$, even more preferably between 8 and 10 ft-lb/in$^2$. A corresponding conditioned impact strength may be between 5 and 10 ft-lb/in$^2$.

In embodiments, the body 12 may advantageously comprise a dry Rockwell Hardness on the R-scale as measured according to the ISO 75-2/B test method of between 50 and 150, in embodiments preferably between 75 and 125, even more preferably between about 100 and 110. The body 12 may have a conditioned Rockwell Hardness of between 25 and 125, in embodiments preferably between 50 and 100, even more preferably between about 60 and 80.

Figure 10:
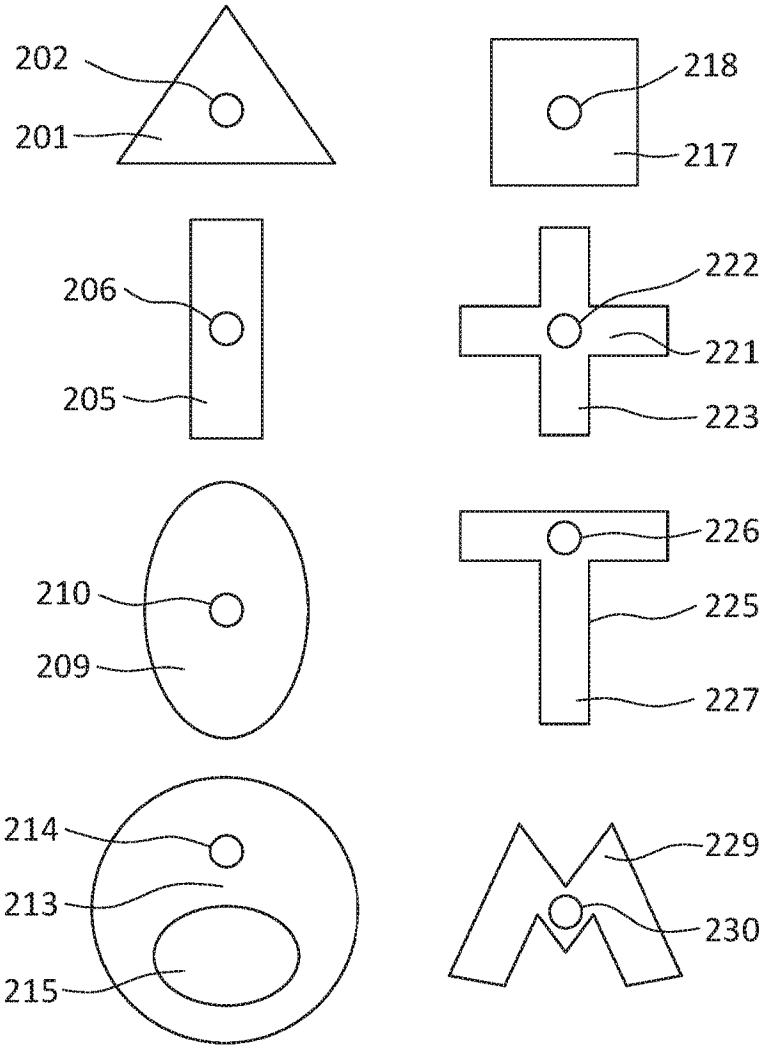
FIG. 10 illustrates a top view of a number of stops according to embodiments of the disclosure.

Turning to FIG. 10, a plurality of stop embodiments is shown. The plurality of stops illustrate a number of possible configurations of the stop. In embodiments, a stop 201 may be configured in a generally triangular configuration and may comprise a hole or aperture 202 extending through a thickness thereof at any suitable location. A triangular stop 201 may have any suitable configuration and combination of angles and edge lengths. A stop 205 may have configured in a generally rectangular configuration and may comprise a hole 206 extending through a thickness thereof at any suitable location. A rectangular stop 205 may have a hole at any suitable length and width, and need not be symmetrically arranged.

A stop 209 may be configured in a generally ovular configuration and may comprise a hole or aperture 210 extending through a thickness thereof at any suitable location. An ovular stop 209 may have any suitable length, width, and shape. A stop 213 may be configured in a generally ovular configuration and may comprise a hole or aperture 214 configured to receive and cooperate with an adjustable golf tee body as described herein, and an aperture 215 extending at least through a partial thickness thereof. The aperture 215 may increase flexibility and decrease weight, for example. In embodiments, the stop 213 rather comprises a thickened portion 215 configured to impart greater strength and stiffness.

A stop 217 may be configured in a generally square configuration and may comprise a hole 218 at any suitable location through a thickness of the stop 217. The stop 217 may have any suitable configuration and need not be perfectly square. A stop 221 may comprise one or more arms 223 extending outwardly, with a hole 222 defined through a thickness of the stop 221. While four arms 223 are shown and depicted, it will be appreciated that any number of arms 223 may be utilized and may extend in any suitable length and configuration.

A stop 225 may be configured in a "T-shape" configuration and may comprise a hole 226 extending through a thickness thereof at any suitable location. In the depicted embodiment, the hole 226 extends through a junction of the T-shape, but in other embodiments, the hole 226 may extend through an arm 227 of the T-shape. A stop 229 may be configured in an "M-shape" configuration. While an M-shape has been shown, it will be appreciated that any suitable configuration, including any letter, number, symbol, logo, or otherwise, may be used and is contemplated. The stop 229 may comprise a hole 230 arranged at any suitable location along the M-shape.

Figure 11:
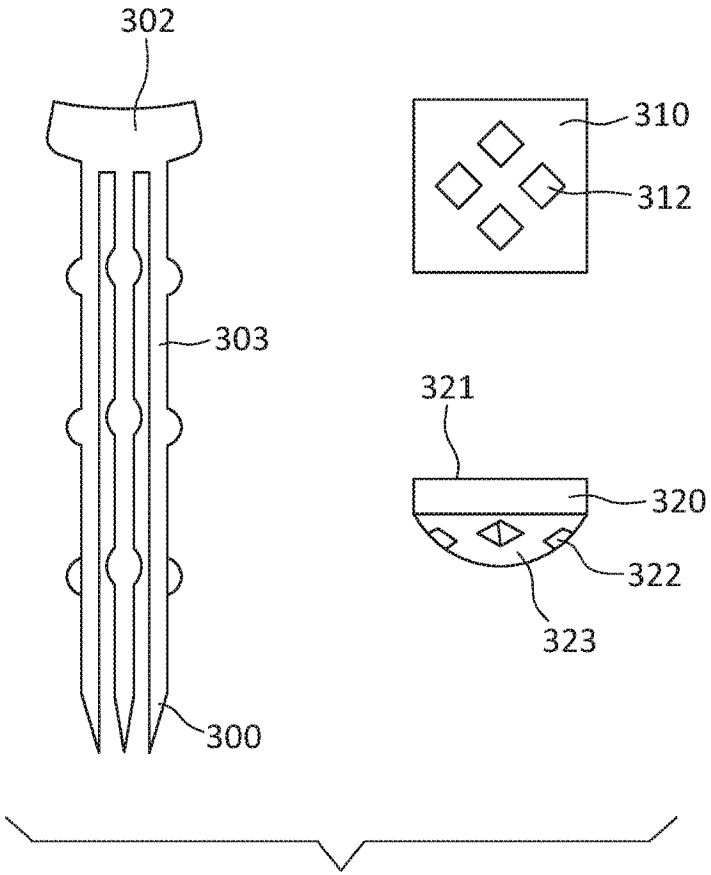
FIG. 11 illustrates an elevational view of an embodiment of an adjustable golf tee, a top view of a stop according to one embodiment, and an elevational view of a stop according to another embodiment according to the present disclosure.

Turning to FIG. 11, an adjustable golf tee 300 according to another embodiment is shown in elevational view. The adjustable golf tee 300 may comprise a body 303 including one or more distinct legs 303 and a head 302 from which the legs extend. The body 303 may be monolithic in embodiments or may have one or more distinct legs as shown. The legs need not be symmetric but rather may be arranged in any configuration about the head 302 and with any size or shape. A stop 310 configured to cooperate with the adjustable golf tee 300 is shown in plan or top view. The stop 310 may have one or more holes 312 configured to receive one or more of the legs 303 of the adjustable golf tee. In embodiments, the stop 310 may have as many holes 312 as there are legs 303 of the adjustable golf tee 300.

A stop 320 configured to cooperate with the adjustable golf tee 300 is shown in elevational view. The stop 320 may have a top portion 321 and a bottom ground-contacting portion 323. The stop 320 may have one or more holes 322 extending through a thickness thereof and configured to receive one or more legs 303 of the adjustable golf tee 300. The top portion 321 may have a different configuration than the bottom portion 323. For example, the top portion 321 may be substantially flat or planar and then bottom portion 323 may have a rounded profile. The top portion 321 and the bottom portion 323 may be monolithic or may be attached to each other by an adhesive or any other suitable mechanism.

Figure 12:
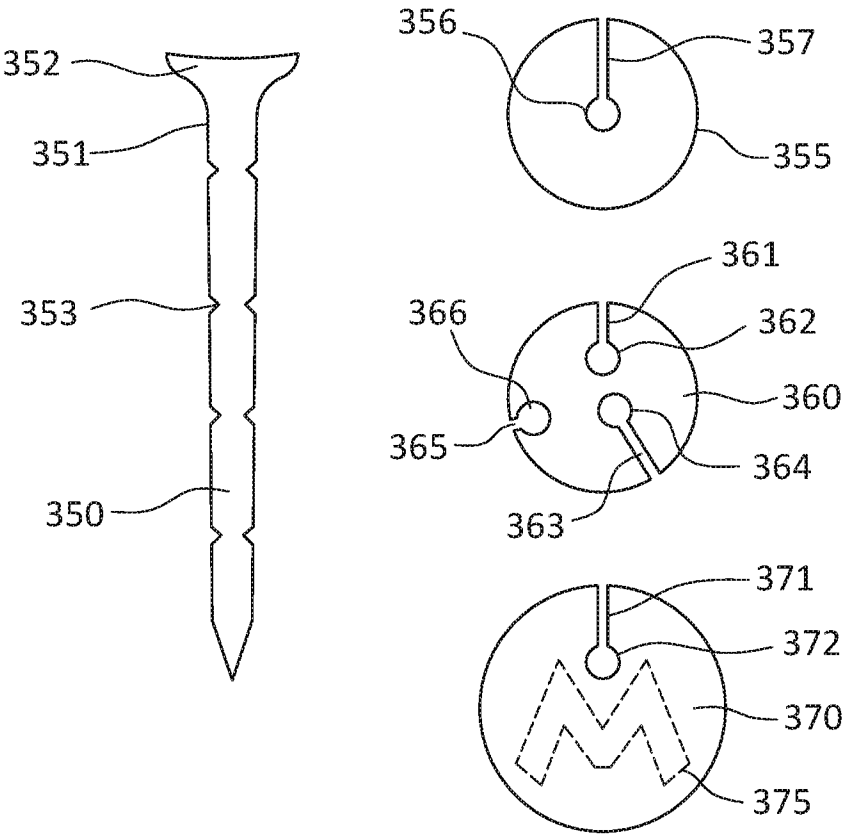
FIG. 12 illustrates an elevational view of an embodiment of an adjustable golf tee and a top view of a stop according to different embodiments of the present disclosure.

Turning to FIG. 12, an adjustable golf tee 350 comprises a head 352 and a body 351 extending therefrom having one or more notches 353. The notches 353 may be arranged in any suitable number along a length of the body 351. The notches 353 may be configured to cooperate with a stop as described herein to set a height of the adjustable golf tee 350. Stops 355, 360, 370 configured to cooperate with an adjustable golf tee 350 as described herein are depicted in plan or top view. The stops 355, 360, 370 may comprise one or more apertures arranged to fit about at least a portion of a body 351 and/or a notch 353 of the adjustable golf tee 350.

As seen from the stop 355, an aperture 356 may cooperate with a slit 357 configured to allow the stop 355 to flex so as to attach the stop 355 about a desired location on the body 351. For example, instead of inserting the body 351 axially through the aperture 356, the slit 357 may be bent open to attach the stop 355 radially about the body 351, such as at a notch 353.

As seen from the stop 360, a plurality of apertures 362, 364, 366 and corresponding slits 361, 363, 365 may be provided about the stop 360 and may extend to a different radial depth within the stop 360. As seen from the stop 370, an aperture 372 and corresponding slit 371 may be provided and may overlap with or extend separately from a printed feature 375. In embodiments, the printed feature 375 may be a corporate logo, a novelty or cartoon image, or otherwise. The printed feature 375 may be applied using any suitable printing modality.

Figure 13:
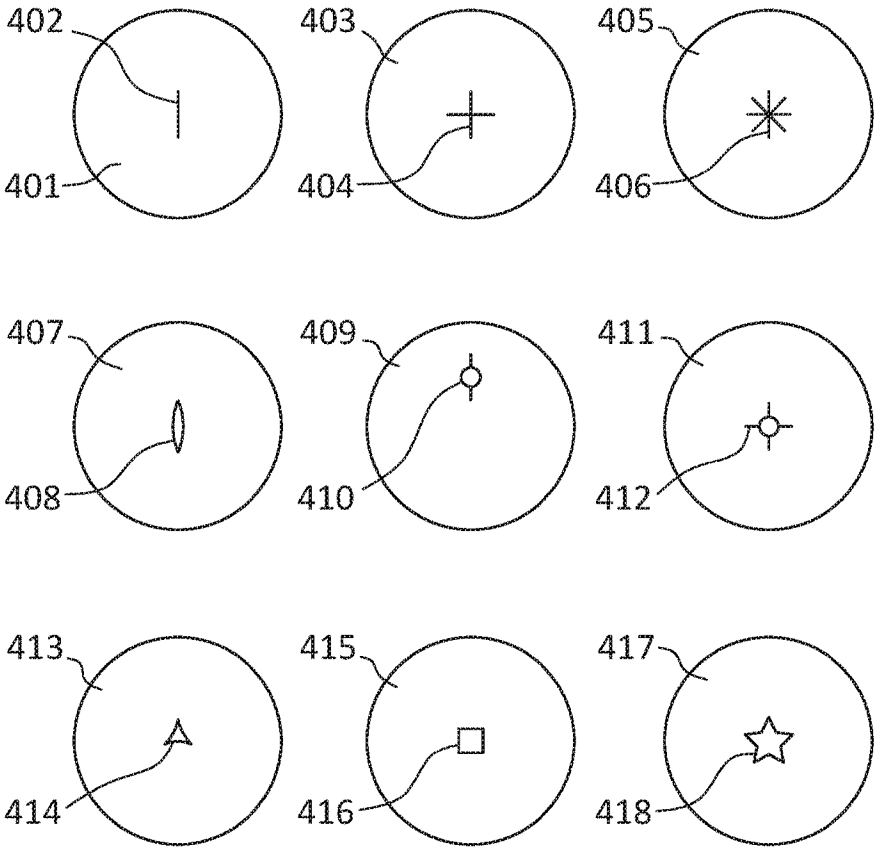
FIG. 13 illustrates a top view of embodiments of a stop.

Turning to FIG. 13, a plurality of stops suitable for use in an adjustable golf tee according to embodiments are shown in plan or top view. A stop 401 may comprise an aperture 402 formed as a flexible longitudinal slit 402 extending through a thickness of the stop 401, the slit 402 being flexible so as to allow a body of an adjustable golf tee to extend therethrough. A stop 403 may comprise an aperture 404 formed as a flexible bidirectional slit 404 extending through a thickness of the stop 403. Likewise a stop 405 may comprise a flexible multidirectional slit 406 extending through a thickness of the stop 405. Using slits as shown in stops 401, 403, 405 advantageously may reduce manufacturing costs and complexity and may reduce a degree to which the stop 401, 403, 405 has to be open on an interior portion thereof.

A stop 407 may comprise a slit 408 configured to open at a center portion thereof and flexible to allow a body of an adjustable golf tee to extend therein or therethrough. A stop 409 may comprise an aperture 410 formed as a hole combined or configured to cooperate with a longitudinal or unidirectional slit, the slit allowing the hole to expand as needed to cooperate with and receive a body of an adjustable golf tee. Similarly, a stop 411 may comprise an aperture 412 formed as a hole combined or configured to cooperate with a bidirectional slit. Additional configurations comprising an aperture and a slit are contemplated.

A stop 413 may comprise an aperture or hole having a triangular configuration 414. A stop 415 may comprise an aperture or hole having a rectangular configuration 416. A stop 417 may comprise an aperture or hole having a non-uniform or novelty configuration 418. Any suitable configuration of hole may be used as suitable, including uniform or non-uniform shapes, sizes, and locations about the stop, which may have any shape, size, or configuration, including circular, rectangular, polygonal, or otherwise.

Figure 14:
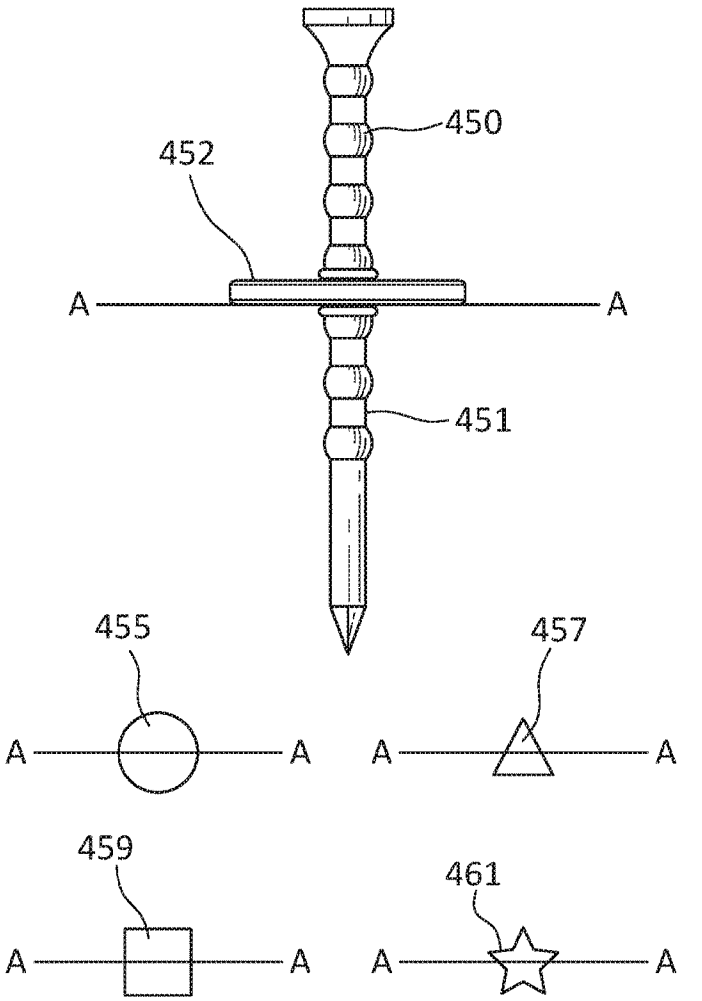
FIG. 14 illustrates an elevational view of an adjustable golf tee and a bottom view of embodiments of an adjustable golf tee.

Turning now to FIG. 14, an adjustable golf teen 450 according to embodiments, comprising a body 451 and cooperating with a stop 452, is shown extending into a ground surface defined about an axis A-A. A top view is provided of alternative embodiments of an adjustable golf tee extending into the ground, with a circular profile 455, a triangular profile 457, a rectangular profile 459, and an irregular or novelty profile 461 of the body of the adjustable golf tee. The disclosure is not limited to the depicted configurations, but rather may extend to any suitable shape, size, or configuration.

Figure 15:
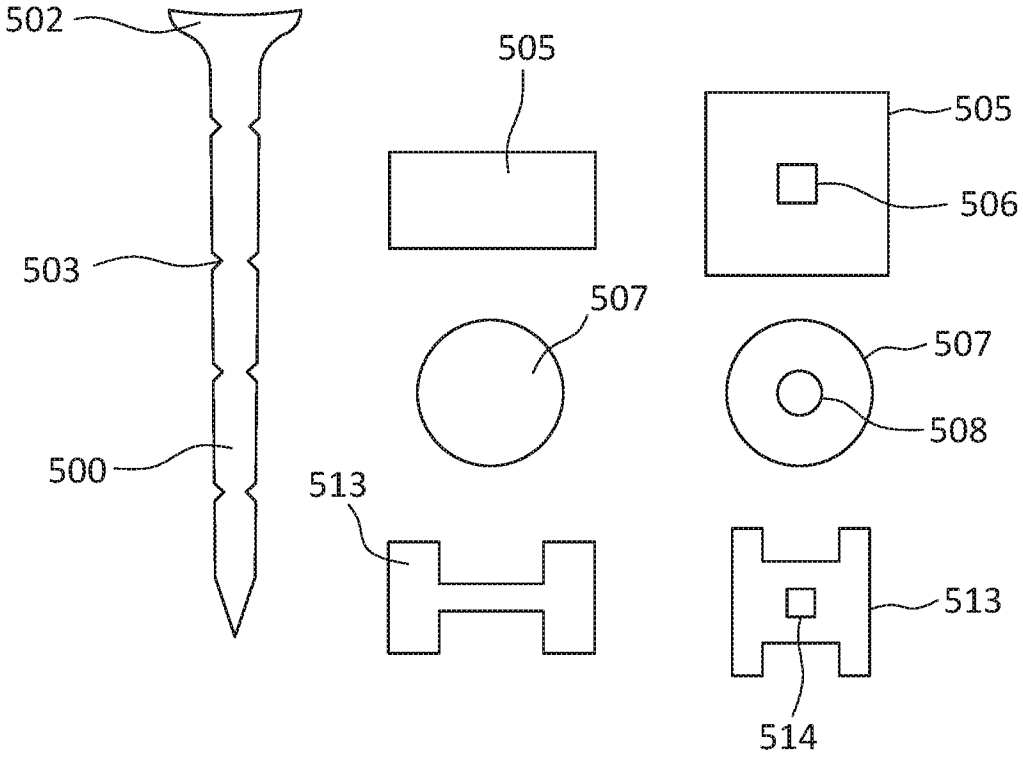
FIG. 15 illustrates an elevational view of an adjustable golf tee, and side and top views respectively of embodiments of a stop configured to cooperate with the adjustable golf tee.

Turning now to FIG. 15, an adjustable golf tee 500 according to the disclosure may comprise a head 502, a body extending therefrom, a one or more notches 503 as described herein. Shown in elevational side view and top or plan view are stops 505, 507, 513. The stops 505, 507, 513 may have any suitable configuration, such as rectangular as in the stop 505, spherical or circular as in the stop 507, and comprising one or more legs as in the stop 513. The stops 505, 507, 5213 may comprise one or more holes or apertures 506, 508, 514, respectively, extending at least partially therethrough. The stops 505, 507, 513 may have any suitable configuration and are not limited to the depicted shapes, but rather may be any size, shape, or configuration.

Not necessarily all such objects or advantages may be achieved under any embodiment of the disclosure. Those skilled in the art will recognize that the disclosure may be embodied or carried out to achieve or optimize one advantage or group of advantages as taught without achieving other objects or advantages as taught or suggested.

The skilled artisan will recognize the interchangeability of various components from different embodiments described. Besides the variations described, other known equivalents for each feature can be mixed and matched by one of ordinary skill in this art to construct an adjustable golf tee under principles of the present disclosure. Therefore, the embodiments described may be adapted any suitable device.

Although the adjustable golf tee has been disclosed in certain preferred embodiments and examples, it therefore will be understood by those skilled in the art that the present disclosure extends beyond the disclosed embodiments to other alternative embodiments and/or uses of the hinge assembly and obvious modifications and equivalents. It is intended that the scope of the present adjustable golf tee disclosed should not be limited by the disclosed embodiments described above, but should be determined only by a fair reading of the claims that follow.

The present invention may be embodied in other specific forms without departing from its spirit or essential characteristics. The described implementations are to be considered in all respects only as illustrative and not restrictive. The scope of the invention is, therefore, indicated by the appended claims rather than by the foregoing description. While certain implementations and details have been included herein and in the attached invention disclosure for purposes of illustrating the invention, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

The invention claimed is:

1. An adjustable golf tee, comprising:

a body extending from a head;

a plurality of bulbous portions extending radially from the body, including a first bulbous portion and a second bulbous portion, each of the bulbous portions being spaced apart along a longitudinal axis of the body by space portions such that a respective one of said space portions is provided between each adjacent pair of said bulbous portions; and a flexible stop having an aperture with a contact surface, the flexible stop being configured to be adjustably and alternatively secured to the body at each of said space portions between each adjacent pair of said bulbous portions such that the contact surface of the flexible stop contacts the body to form a flexible connection between the flexible stop and the body, wherein the flexible stop includes central protrusions surrounding the aperture, the central protrusions including a first central protrusion surrounding the aperture on a first side of the flexible stop and a second central protrusion surrounding the aperture on a second side of the flexible stop, the first side of the flexible stop being opposite from the second side of the flexible stop, wherein flexion is provided in an angle between a plane of the flexible stop and the longitudinal axis of the body by the flexible stop having a thickness at the contact surface of the aperture in a direction parallel to the longitudinal axis of the body, and the thickness of the flexible stop at the contact surface of the aperture being less than a distance in the longitudinal axis of the body between the first bulbous portion at a maximum diameter of the first bulbous portion and the second bulbous portion at a maximum diameter of the second bulbous portion, wherein the first central protrusion extends in a first direction beyond a transition angle from an outer surface of the body and an outer surface of the first bulbous portion, the first direction being parallel to the longitudinal axis of the body, and wherein the second central protrusion extends in a second direction beyond a transition angle from the outer surface of the body and an outer surface of the second bulbous portion, the second direction being parallel to the longitudinal axis and opposite to the first direction.

2. The adjustable golf tee of claim 1, wherein the flexible stop is configured to act as an insertion barrier when the body of the tee is inserted into a ground during use.

3. The adjustable golf tee of claim 2, wherein a position of the flexible stop along a length of the body of the tee determines a depth at which the tee can be inserted into a ground surface and thus a height at which a ball sits on top of the head during use.

4. The adjustable golf tee of claim 1, wherein the central hole is flexible such that a diameter of the central hole expands and elastically returns as the body and the bulbous portions are inserted through the central hole during use.

5. The adjustable golf tee of claim 1, wherein a diameter of the central hole is less than a diameter of each of the plurality of bulbous portions.

6. The adjustable golf tee of claim 1, wherein the bulbous portions are spherical or semispherical.

7. The adjustable golf tee of claim 1, wherein the flexible stop is configured to absorb at least a portion of one or more forces acting on the tee when a golf club strikes the tee during use.

8. An adjustable golf tee, comprising:

a body extending from a head, the body comprising a plurality of bulbous portions extending radially from the body, including a first bulbous portion and a second bulbous portion, each of the bulbous portions being spaced apart along a longitudinal axis of the body by space portions such that a respective one of said space portions is provided between each adjacent pair of said bulbous portions; and a flexible stop configured to be adjustably and alternatively secured to the body at each of said space portions between each adjacent pair of said bulbous portions, the flexible stop comprising:

a disc;

an aperture extending through the disc, the aperture having a contact surface configured that the contact surface of the flexible stop contacts the body to form a flexible connection between the flexible stop and the body; and central protrusions surrounding the aperture, the central protrusions including a first central protrusion surrounding the aperture on a first side of the flexible stop and a second central protrusion surrounding the aperture on a second side of the flexible stop, the first side of the flexible stop being opposite from the second side of the flexible stop;

wherein flexion is provided in an angle between a plane of the flexible stop and the longitudinal axis of the body by the flexible stop having a thickness at the contact surface of the aperture in a direction parallel to the longitudinal axis of the body, and the thickness of the flexible stop at the contact surface of the aperture being less than a distance in the longitudinal axis of the body between the first bulbous portion at a maximum diameter of the first bulbous portion and the second bulbous portion at a maximum diameter of the second bulbous portion, wherein the first central protrusion extends in a first direction beyond a transition angle from an outer surface of the body and an outer surface of the first bulbous portion, the first direction being parallel to the longitudinal axis of the body, and wherein the second central protrusion extends in a second direction beyond a transition angle from the outer surface of the body and an outer surface of the second bulbous portion, the second direction being parallel to the longitudinal axis and opposite to the first direction.

9. The adjustable golf tee of claim 8, wherein the adjustable golf tee is configured to be adjustably secured between an adjacent pair of the plurality of bulbous portions.

10. The adjustable golf tee of claim 8, wherein the central hole of the stop is flexible so that the diameter of the central hole expands to allow each of the plurality of bulbous portions to pass through the central hole when the body is inserted through the central hole and elastically reduces when a portion of the body between an adjacent pair of the plurality of bulbous portions is inserted through the central hole.

11. The adjustable golf tee of claim 8, wherein the body of the tee comprises impact-modified nylon resin.

12. The adjustable golf tee of claim 8, wherein the stop comprises a thermoplastic polyurethane.

13. The adjustable golf tee of claim 12, wherein the stop has a shore hardness of between about 70 A and 100 A.

14. The adjustable golf tee of claim 12, wherein the stop has a tensile yield strength between about 500 psi and 700 psi.

15. The adjustable golf tee of claim 12, wherein the stop has an ultimate tensile strength between about 2,700 psi and 5,000 psi.

16. The adjustable golf tee of claim 12, wherein the stop has an elongation at yield of between about 50% and 80%.

17. The adjustable golf tee of claim 12, wherein the stop has an elongation at break of between about 500% and 800%.

18. A method of placing golf tee of claim 1 at a consistent height, the method comprising:

providing the golf tee;

disposing the flexible stop along a length of the body; and inserting the body into a ground until the flexible stop contacts the ground and prevents a length of the body disposed above the flexible stop from being inserted into the ground.

19. The adjustable golf tee of claim 1, wherein a transition angle from an outer surface of the body at each of said space portions to an outer surface of the respective bulbous portions is an obtuse angle.

* * * * *